US006802268B2

(12) United States Patent
Kroemmer et al.

(10) Patent No.: US 6,802,268 B2
(45) Date of Patent: Oct. 12, 2004

(54) DEVICE FOR DISCHARGING DUST FROM A DRY DUST COLLECTOR OF A BLAST FURNACE

(75) Inventors: Yvan Kroemmer, Goetzingen (LU); Norbert Coone, Stekene (BE)

(73) Assignee: Paul Wurth S.A., Luxembourg (LU)

( * ) Notice: Subject to any disclaimer, the term of this patent is extended or adjusted under 35 U.S.C. 154(b) by 0 days.

(21) Appl. No.: 10/258,502

(22) PCT Filed: Apr. 26, 2001

(86) PCT No.: PCT/EP01/04727

§ 371 (c)(1),
(2), (4) Date: Oct. 25, 2002

(87) PCT Pub. No.: WO01/81636

PCT Pub. Date: Nov. 1, 2001

(65) Prior Publication Data

US 2003/0075085 A1 Apr. 24, 2003

(30) Foreign Application Priority Data

Apr. 26, 2000 (LU) ..... 90585

(51) Int. Cl.[7] ..... F23N 5/18; F23K 3/02

(52) U.S. Cl. ..... 110/186; 110/189; 110/293; 110/101 R; 110/101 CF; 110/169

(58) Field of Search ..... 110/186, 188, 110/189, 293, 101 R, 104 R, 101 C, 101 CF, 101 CB, 101 CD, 169, 129

(56) References Cited

U.S. PATENT DOCUMENTS 738,133 A * 9/1903 Weaver ..... 406/68
4,368,678 A 1/1983 Ulveling
4,389,949 A * 6/1983 Heep ..... 110/101 CF
4,397,591 A 8/1983 Carney, Jr. et al.
4,570,552 A * 2/1986 Rachner et al. ..... 110/347
4,594,028 A 6/1986 Ulveling
4,758,118 A 7/1988 Rachner et al.

FOREIGN PATENT DOCUMENTS

| | | |
|---|---|---|
| DE | 2806139 | 8/1979 |
| EP | 0090923 | 10/1983 |
| EP | 0656516 | 6/1995 |
| FR | 2344767 | 10/1977 |
| GB | 1148348 | 4/1969 |
| GB | 2144522 | 3/1985 |
| JP | 57077119 | 5/1982 |
| JP | 59185711 | 10/1984 |
| JP | 61018635 | 1/1986 |

* cited by examiner

*Primary Examiner*—Kenneth B Rinehart
(74) *Attorney, Agent, or Firm*—McCormick, Paulding & Huber LLP

(57) ABSTRACT

A device for discharging dust from a dry dust collector of a blast furnace includes a dust discharge vent located downstream of a dust discharge opening of the dry dust collector. A fully enclosed dust conveying system is located downstream of the dust discharge valve and provides mechanized transport of the dust discharged through the discharge valve. A control system is utilized to control the opening of the dust discharge valve in relation to the residual conveying capacity of the dust conveying system.

18 Claims, 4 Drawing Sheets

Fig. 3
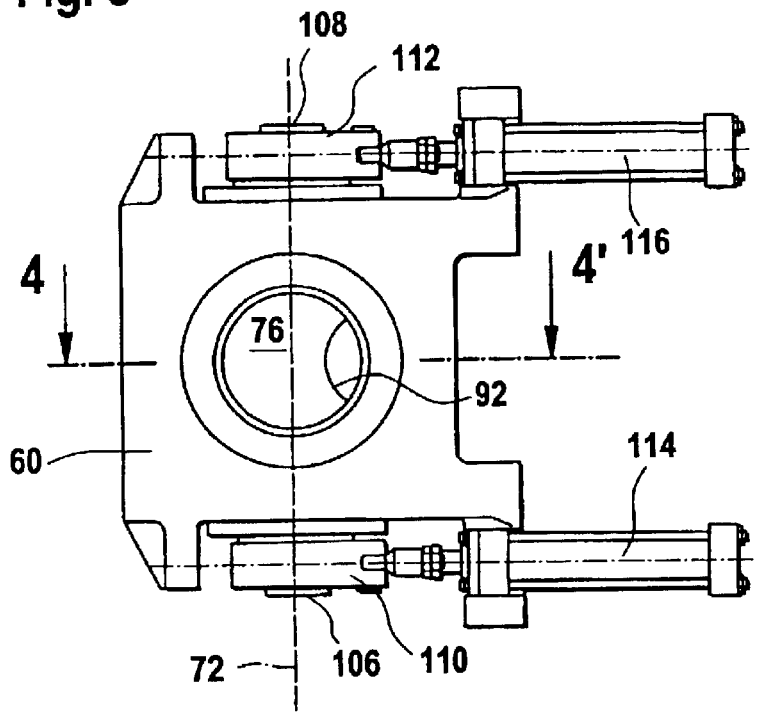
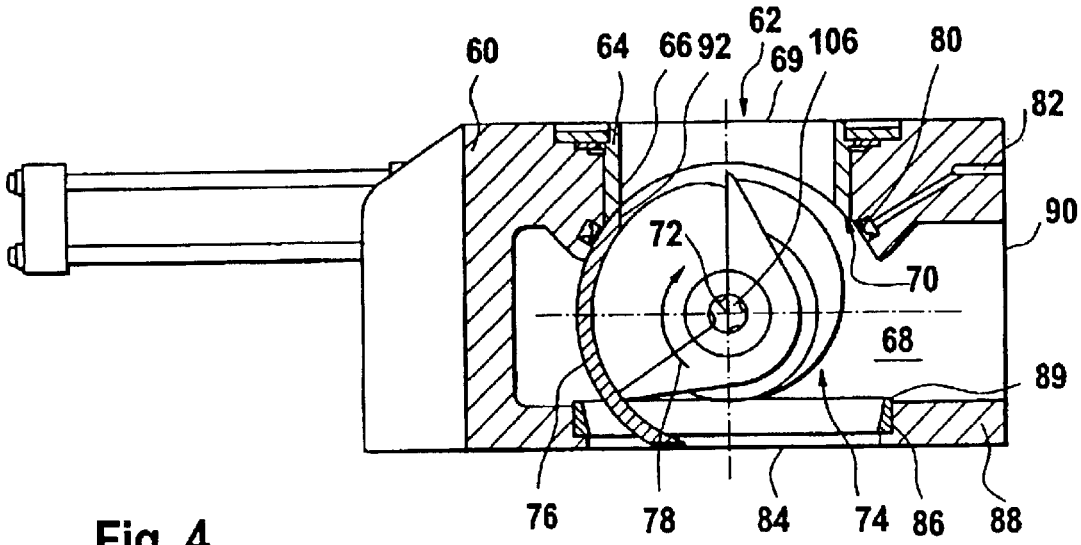
Fig. 4

DEVICE FOR DISCHARGING DUST FROM A DRY DUST COLLECTOR OF A BLAST FURNACE

FIELD OF THE INVENTION

The present invention relates to a device for discharging dust from a dry dust collector of a blast furnace.

BACKGROUND OF THE INVENTION

The object of a dry dust collector of a blast furnace (as e.g. a dust-catcher, a cyclone or a filter) is to remove in a dry state as much as possible of the dust with which the blast furnace gas is heavily laden, before the blast furnace gas passes into succeeding wet-cleaning units. Such dry dust collectors generally have a cone bottom in which the blast furnace dust accumulates and from where it must periodically be evacuated.

Known devices for discharging the dust from the cone bottom of a dry dust collector in a blast furnace plant comprise a fully enclosed mechanical conveyor, normally a conveyor including propelled paddles for pushing the dust through a closed duct. The conveyor collects the blast furnace dust at a dust discharge opening in the cone bottom of the dry dust collector to drop it e.g. into a railroad car. Water is injected into the conveyor so as to slightly moisten the blast furnace dust, thus preventing the dust from blowing around too much as it drops out of the conveyor.

At least one isolating valve is mounted between the conveyor and the dust discharge opening. This isolating valve is used to interrupt dust discharge from the dry dust collector if a new rail road car has to be placed under the outlet of the conveyor or if the dust level in the cone bottom of the dry dust collector has fallen below a certain level. Maintaining a minimum dust level in the cone bottom of the dry dust collector indeed warrants that pressurised gas does not blow through the conveyor when the isolating valves are open.

It is also known to provide a lock with a gastight outlet and inlet valve between the screw conveyor and the dust discharge opening. The gastight dust discharge valve of the look is closed when dust is discharged from the cone bottom of the dry dust collector into the lock. The gastight inlet valve of the lock is closed when dust is discharged from the lock Into the screw conveyor.

Known devices for discharging blast furnace dust comprise isolating valves that have either a plate shaped or a convex cone shaped closing body mounted on an arm that is articulated laterally of the dust discharge opening, so that the closing body can be pivoted around a horizontal axis between a closed position and an open position, wherein it is located completely outside of the dust flow. These valve types are used because they are rather insensitive to clogging and abrasion.

A major problem with known devices for discharging blast furnace dust is that the discharge flow rate of the dust from the cone bottom of the dry dust collector or from the lock is not at all constant This is inter alia due to the fact that the dust can be very fluid at one moment, but can also bake together one moment later. It follows that the operating conditions of the conveyor downstream of the discharge valve are subjected to violent changes. At one moment the conveyor may be running idle and just a moment later there may be a complete clogging in the conveyor.

It will be noted in this context that the standard solution for warranting a more or less uniform discharging of dustlike materials from a hopper is a cellular wheel. This solution is however not at all suited for discharging blast furnace dust from a dry dust collector because the blast furnace dust easily clogs the wheel cells and is also too abrasive for the wheel. Indeed, after a relatively short operating time, the lock edges of the cellular wheel are heavily worn out, so that blast furnace dust simply runs through the stopped cellular wheel.

JP 59-185711 discloses a method for automatically controlling the discharging of blast furnace dust from a dry dust collector. The discharging device disclosed in this document comprises three discharge valves in series, which are successively closed by a microcomputer. A mechanical conveying system, which comprises a screw conveyor and an enclosed belt conveyor in series, is located downstream of the dust discharge valves for providing mechanized transport of the dust discharged through the discharge valves. An oxygen sensor measures the oxygen content in the belt Conveyor. When the sensor detects a sharp decrease in the oxygen content, the discharge valves are closed by the microcomputer. According to JP 59-185711 a sharp decrease in the oxygen content is an indication of a blast furnace gas break-through and an automatic closing of the discharge valves in case of such a gas break-through helps to prevent environmental pollution by black smoke. It will be noted that JP 59-185711 does not concern itself with an improvement of the operating conditions of the mechanical conveying system.

The technical problem underlying the present invention is to provide a simple device for discharging blast furnace dust from a dry dust collector with improved discharging conditions.

SUMMARY OF THE INVENTION

The present invention concerns a device for discharging dust from a dry dust collector of a blast furnace comprising a dust discharge valve located downstream of a dust discharge opening of the dry dust collector and a fully enclosed dust conveying system located downstream of the dust discharge valve. In accordance with an important aspect of the present invention this device comprises a control system that is designed so as to control the opening of the dust discharge valve in function of the residual conveying capacity of the dust conveying system. In other words, the control system closes the discharge valve before the conveying system risks to clog and opens the discharge valve if the conveying load drops. It follows that the average conveying capacity, i.e. average discharge capacity, is substantially increased, whereas the risk of clogging is nevertheless reduced. As a result, breakdowns of the conveying system are less frequent and less overhauling operations are necessary. It will further be appreciated that in a conveying system that is more equally loaded, a gas break through is less probable. Consequently, with a device in accordance with the invention, it is generally not necessary to provide a lock with a gastight outlet and inlet valve between the dust discharge opening and the conveyor.

The conveying system of the device may comprise a fully enclosed mechanical conveyor, wherein the control system is designed so as to control the opening of the dust discharge valve in function of the power absorbed by the mechanical conveyor.

In a preferred embodiment of the device, the fully enclosed conveying system comprises a pneumatic conveying system, wherein the control system is designed so as to control the opening of the dust discharge valve in function of the pressure in the pneumatic conveying system. This device allows to efficiently discharge the blast furnace dust from the dry dust collector in a completely closed circuit. A preferred embodiment of such a pneumatic conveying system for the blast furnace dust comprises: a dust storage hopper located near the blast furnace; a pneumatic conveying conduit connected between the dust discharge valve the dust storage hopper, for transporting the discharged dust from the dry dust collector to the dust storage hopper; a fluidizing hopper connected to the dust storage hopper; and injection means for injecting the fluidized dust into the blast furnace.

It will be appreciated that the present invention also provides a dust discharge valve that is excellently suited for providing the required control function in the discharging device. This dust discharge valve includes: a housing with an inlet opening bounded by a concave annular surface that lies on a first fictive cylinder having a horizontal central axis; and a closing body mounted in the housing so that it can be pivoted around the horizontal central axis between a closed position and an open position. The closing body of this valve has a convex cylindrical closing surface that lies on a second fictive cylinder, which has a diameter that is slightly smaller than the diameter of the first fictive cylinder. In order to prevent that this valve is damaged or blocked by bigger nodules of agglomerated dust during the closing operation, its closing body is advantageously provided with a cutting edge that sweeps across the inlet opening when the closing body is pivoted between the closed position and the open position. Such a cutting edge is capable of shearing even very hard nodules of agglomerated dust when the valve closes. It will be noted that the cutting edge is advantageously given a concave form, so that shearing takes place mainly during the end phase of the closing movement. If the concave cutting edge is moreover substantially symmetric with regard to a center plane of the closing body, it is warranted that the closing body is more or less symmetrically charged during the shearing operation.

In a preferred embodiment of the discharge valve, the closing body includes a cylindrical closing plate with two lateral flanges, each of the flanges supporting a lateral journal. The housing of this valve includes a vertical dust passage channel below its inlet opening and a bearing located on either side of the dust passage channel for supporting each of the two journals of the closing body, so that the latter can be pivoted around the aforementioned horizontal central axis. It will be appreciated that the vertical dust passage channel is completely free when the closing body is in its open position. In other words, no component of the valve is located in the highly abrasive dust stream in the vertical dust passage.

In a preferred embodiment the closing includes a cylindrical closing plate with two lateral flanges, wherein the closing plate and the lateral flanges are made in one piece of metal carbide. Secured to each of these metal carbide flanges is a mating steel flange that supports a steel journal. It will be appreciated that this design makes it possible to obtain a metal carbide closing body with two perfectly aligned journals.

The housing of the discharge valve includes advantageously an inflatable seal, which is mounted around the concave annular surface so that it is pressed against the closing surface in the closed position when it is inflated, but spaced therefrom when it is deflated. This embodiment of the discharge valve warrants a gastight closure. It will be appreciated that the sealing element has a considerable service life, because it is exposed neither to contact with the dust stream, nor to contact with the pivoting closing surface.

The housing of the valve may furthermore include an outlet opening bounded by a ring made of metal carbide, wherein the ring is mounted in a ground plate below the closing body, so as to define a retaining shoulder for retaining a dust cushion on the ground plate around the outlet opening. This embodiment of the discharge valve distinguishes itself by an excellent wear resistance of the valve housing at the level of its outlet opening.

BRIEF DESCRIPTION OF THE DRAWINGS

The present invention will now be described, by way of example, with reference to the accompanying drawings, in which:

FIG. 3: is a top view of a discharge valve to be used in the device of FIG. 1 or FIG. 2;

FIG. 4: is a section along the line 4–4' in FIG. 3; and

DETAILED DESCRIPTION OF PREFERRED EMBODIMENTS

Figure 1:
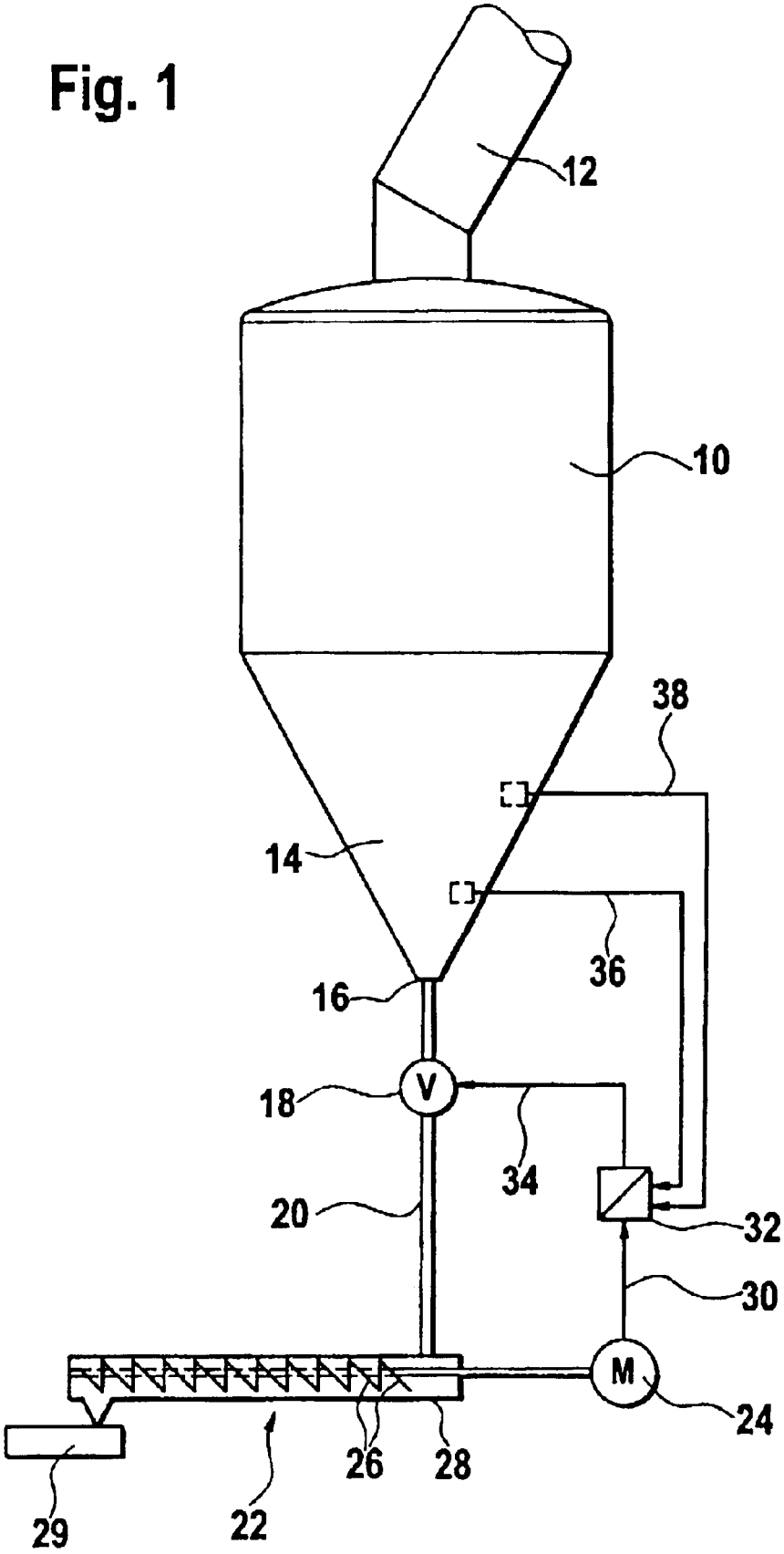
FIG. 1: is a diagrammatic view of a first embodiment of the device for discharging dust from a dry dust collector of a blast furnace.
Figure 2:
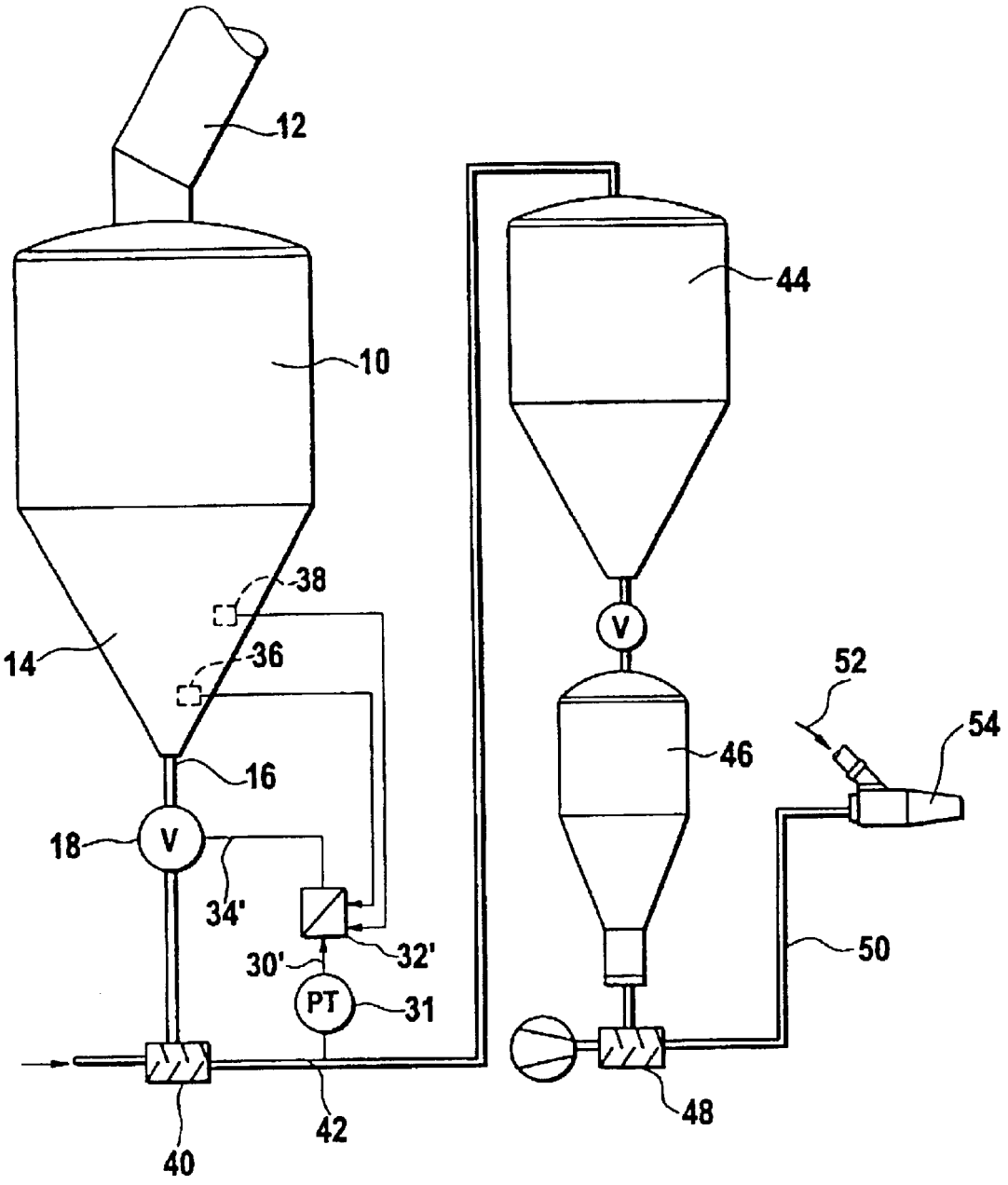
FIG. 2: is a diagrammatic view of a second embodiment of the device for discharging dust from a dry dust collector of a blast furnace.

Reference number 10 in FIGS. 1 & 2 identifies a dust-catcher of a blast furnace plant. This dust-catcher is a dry dust collector whose object is to remove as much as possible of the flue dust blown from the blast furnace gas, before the latter is wet-cleaned in succeeding wet-cleaning units. It is indeed easier and more economical to handle the blast furnace dust in a dry state than in a wet state.

Reference number 12 in FIGS. 1 & 2 identifies a single downcomer coming from the top of the blast furnace and carrying the blast furnace gas, which is heavily loaded with flue dust, to the top of the dust-catcher 10. In the latter, about 60 to 75% of the dust load of the blast furnace gas drops out of the gas stream and accumulates in a cone bottom 14 of the dust-catcher 10. This cone bottom 14 is provided with a dust discharge opening 16, which is equipped with a dust discharge valve 18. It will be noted that the gas pressure in the dust catcher is only slightly smaller than the gas pressure in the blast furnace.

In the embodiment of FIG. 1, a conduit 20 connects the outlet of the discharge valve 18 to an inlet port of a fully enclosed mechanical conveyor 22, which is known per se. This conveyor includes at least one electrical motor 24 for propelling a set of paddles 26, which push the dust through a closed duct 28. At its outlet opening the conveyor 22 drops the dust into a recipient 29, which may be e.g. a railroad car. The electrical power absorbed by the mechanical conveyor 22 is a function of its instantaneous conveying load. This electrical power is continuously measured and used as controlled value 30 in a control system 32, which produces a control signal 34 for the for the discharge valve 18. If the electrical power absorbed by the mechanical conveyor 22 exceeds a pre-set value, the discharge valve 18 receives a control signal to close. If the electrical power absorbed by the mechanical conveyor 22 falls below said pre-set value, the discharge valve 18 receives a control signal to open. It follows that the mechanical conveyor 22 is more equally loaded, whereby gas break through and clogging become less probable. With the cone bottom 14 are associated a low level probe 36 and a high level probe 38. A high level signal from the high level probe 38 is used to start the discharging operation. A low level signal from the low level probe 36 is used to close the valve 18 and stop the discharging operation.

In the embodiment of FIG. 2, the outlet of the discharge valve 18 is connected via pneumatic injector 40 to a pneumatic conveying conduit 42. The latter is used to transport the dust into a dust storage hopper 44 located near the blast furnace. Blast furnace gas from the dust catcher 10 or an auxiliary gas, preferably an inert gas as for example nitrogen, may be used as transporting gas in the pneumatic conveying conduit 42. The pressure in the pneumatic conveying conduit 42 is continuously measured by a probe 31 and used as controlled value 30' in a control system 32', which produces a control signal 34' for the discharge valve 18. If the pressure in the pneumatic conveying conduit 42 exceeds a pre-set value, which is an indication that the dust stream is getting denser, the discharge valve 18 receives a control signal to close and less dust is injected into the conduit 42. If the pressure in the pneumatic conveying conduit 42 falls below a pre-set value, which is an indication that the dust stream is getting less dense, the discharge valve 18 receives a control signal to open and more dust is injected into the conveying conduit 42. Just as for the device of FIG. 1, a high level signal from the high level probe 38 is used to start the discharging operation, and a low level signal from the low level probe 36 is used to close the valve 18 and stop the discharging operation.

It will be appreciated that the device of FIG. 2 is a completely closed system. From the storage hopper 44 the dust is discharged into a fluidising hopper 46, which is located nearer to the blast furnace. This fluidising hopper 46 is connected vian injector 48 to a pneumatic distribution system 50, which is used to inject the blast furnace dust with the hot-blast 52 through blast connections 54 back into the blast furnace.

A preferred embodiment of the discharge valve 18 will now be described with reference to FIGS. 3 to 5. This discharge valve 18 includes a housing 60 with a dust passage channel 62 passing vertically across. At the inlet side the vertical dust passage channel is formed by an exchangeable wear resistant inlet tube 64 that is removably secured in the housing 60. This inlet tube 64 has a lower edge 66 that is slightly protruding into an internal valve chamber 68, wherein it defines an inlet opening 69 for the dust. This inlet opening 69 is bounded by a concave annular front surface 70 of the lower edge 66, which lies on a first fictive cylinder having a horizontal central axis 72. In other words, the concave annular front surface 70 bounding the inlet opening 69 is formed by the intersection of the lower edge 66 of the vertical inlet tube 64 with a first fictive horizontal cylinder having the horizontal axis 72 as central axis. A closing body 74 is mounted in the internal valve chamber 68, so that it can be pivoted around the horizontal central axis 72. This closing body 74 has a convex cylindrical closing surface 76 that lies on a second fictive cylinder that is coaxial to said first fictive cylinder but has a diameter that is slightly smaller than the latter. It follows that the closing body 74 can be pivoted around the horizontal central axis 72 from the completely open position shown in FIG. 5, wherein the closing body 74 is arranged laterally of the vertical dust passage channel 62, by an angle of about 90° in the direction of the arrow 78 into a closed position, wherein the closing body 74 is arranged centrally under the inlet opening 69. In this closed position the closing body 74 closes the inlet tube 64 with the exception of a small air gap subsisting between the concave annular front surface 70 of the inlet tube 64 and the opposite cylindrical closing surface 76.

It will be noted that the cylindrical closing surface 76 is greater than the cylindrical surface delimited by the outer contour line of the concave annular front surface 70, so that an outer ring surface of the cylindrical closing surface 76 surrounds the concave annular front surface 70 when the closing body 74 is in its completely closed position. This outer ring surface is used as a contact surface for an inflatable seal ring 80 that is mounted in a ring channel in the housing 60, which surrounds the concave annular front surface 70. When the closing body 74 is immobilised in its closed position, the seal ring 80 is inflated through a gas passage 82 and thereby firmly pressed against said outer ring surface of the cylindrical closing surface 76 to provide a gastight sealing of the small air gap subsisting between the concave annular front surface 70 of the inlet tube 64 and the opposite convex cylindrical closing surface 76. When the closing body 74 has to be pivoted, the seal ring 80 is first deflated. It will be appreciated that in its deflated state, the seal ring 80 lies completely within its ring channel, so that it cannot come into contact with the moving cylindrical closing surface 76.

The housing 60 includes an outlet opening 84 of the dust passage channel 62, which is bounded by a ring 86 made of metal carbide. This ring 86 is mounted in a ground plate 88 below the closing body 74, so as to define a small retaining shoulder 89 for retaining a dust cushion on the ground plate 88 around outlet opening 84. This dust cushion helps to protect the rim of the outlet opening 84 against abrasion by the dust flow. A lateral inspection opening 90, which is normally closed in a gastight manner by a plate (not shown in FIG. 4), gives access to the valve chamber 68.

Figure 5:
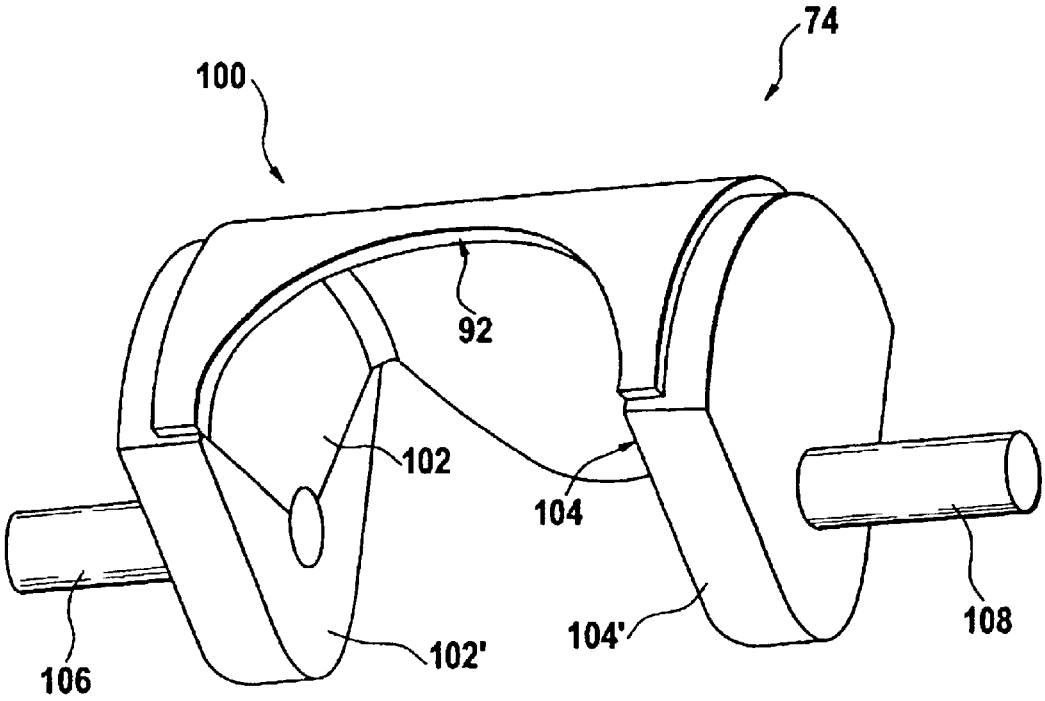
FIG. 5: is a simplified three-dimensional view of a closing body to be used in a discharge valve of FIG. 3.

As can be seen on FIG. 3 and FIG. 5, the closing body 74 has a concave cutting edge 92 that is symmetric with regard to the centre plane of the closing body 74. This cutting edge 92 sweeps across the inlet opening 69 when the closing body 74 is pivoted between its closed position and its open position. It is capable of shearing even very hard nodules of agglomerated dust when the valve closes. As can be seen on FIG. 3, in which the closing body 74 is shown in a position very close to its completely closed position, the special shape of the cutting edge 92 warrants that hard nodules of agglomerated dust are pushed towards the centre plane of the closing body 74. Thus it is warranted that the closing body 74 is subject to a more or less symmetric stress situation during the shearing operation.

Further features of the closing body 74 will now be described with reference to FIG. 5. The preferred closing body 74 shown on FIG. 5 includes a cylindrical closing plate 100 with two lateral flanges 102, 104 (the flange 104, which is not seen in FIG. 5, is symmetrical to the flange 102), wherein the closing plate 100 and the lateral flanges 102, 104 are made in one piece of metal carbide. To each of the metal carbide flanges 102, 104 is secured a mating flange 102', 104', which supports a lateral journal 106, 108, wherein the mating flanges 102', 104' and the journals 106, 108 are made of steel. It will be appreciated that this design makes it possible to obtain a metal carbide closing body with two perfectly aligned journals 106, 108. The latter are used to support the closing body 74 in two gastight bearings (not shown) that are located on either side of the dust passage channel 62, so that the closing body 74 can be pivoted around the aforementioned horizontal central axis 72. Thus, a very resistant closing body 74 is achieved, which is moreover capable of withstanding high shear forces during the closing operation.

Coming back to FIG. 3, it remains to be noted that the two journals 106, 108 axially traverse their gastight bearings. Each journal 106, 108 is provided outside the housing 60 with a crank arm 110, 112. The latter are actuated by two hydraulic cylinders 114, 116, which are equipped with a continuous positioning device, so that the valve 18 can be used for a continuous control of dust discharge, as described above.

What is claimed is:

1. A device for discharging dust from a dry dust collector of a blast furnace comprising:

a dust discharge valve located downstream of a dust discharge opening of said dry dust collector;

a fully enclosed dust conveying system located downstream of said dust discharge valve for providing mechanized transport of the dust discharged through said discharge valve; and a control system that is designed so as to control the opening of said dust discharge valve in function of the residual conveying capacity of the dust conveying system.

2. The device as claimed claim in 1, wherein:

said fully enclosed conveying system comprises a mechanical conveyor; and said control system is designed so as to control the opening of said dust discharge valve in function of the power absorbed by said mechanical conveyor.

3. The device as claimed claim in 2, wherein said fully enclosed mechanical conveyor is connected without any lock chamber to said dust discharge valve and the latter is connected without any lock chamber to said dust discharge opening of said dry dust collector.

4. The device as claimed claim in 1, wherein:

said fully enclosed conveying system comprises a pneumatic conveying system; and said control system is designed so as to control the opening of said dust discharge valve in function of the pressure in said pneumatic conveying system.

5. The device as claimed claim in 4, wherein said pneumatic conveying system comprises:

a dust storage hopper located near the blast furnace;

a pneumatic conveying conduit connected between said dust discharge valve said dust storage hopper, for transporting the discharged dust from said dry dust collector to said dust storage hopper;

a fluidizing hopper connected to said dust storage hopper; and injection means for injecting the fluidized dust into the blast furnace.

6. The device as claimed in claim 1, wherein said dust discharge valve includes:

a housing including an inlet opening, said inlet opening being bounded by a concave annular surface that lies on a first fictive cylinder having a horizontal central axis; and a closing body mounted in said housing so that it can be pivoted around said horizontal central axis between a closed position and an open position, wherein said closing body has a convex cylindrical closing surface that lies on a second fictive cylinder, which has a diameter that is slightly smaller than the diameter of said first fictive cylinder.

7. The device as claimed in claim 6, wherein said closing body has a cutting edge that sweeps across said inlet opening when said closing body is pivoted between said closed position and said open position.

8. The device as claimed in claim 7, wherein said cutting edge has a concave shape.

9. The device as claimed in claim 6, wherein said convex cylindrical closing surface is made of a wear resistant material.

10. The device as claimed in claim 6, wherein:

said closing body includes a cylindrical closing plate with two lateral flanges, each of said lateral flanges supporting a lateral journal; and said housing includes a vertical dust passage channel below said inlet opening and a bearing located on either side of said dust passage channel for supporting each of said two lateral journals, so that said closing body can be pivoted around said horizontal central axis.

11. The device as claimed in claim 6, wherein said closing body comprises:

a cylindrical closing plate with two lateral flanges, wherein said closing plate and said lateral flanges are made in one piece of metal carbide; and secured to each of said metal carbide flanges, a mating steel flange that supports a steel journal.

12. The device as claimed in claim 6, wherein said housing includes an inflatable seal ring, which is mounted around said concave annular surface so that it is pressed against said closing surface in said closed position when it is inflated, but spaced therefrom when it is deflated.

13. The device as claimed in claim 6, wherein said housing includes an outlet opening in a ring made of metal carbide, wherein said ring is mounted in a ground plate below said closing body, so as to define a retaining shoulder for retaining a dust cushion on said ground plate around said outlet opening.

14. A device for discharging dust from a dry dust collector of a blast furnace comprising:

a dust discharge valve located downstream of a dust discharge opening of said dry dust collector;

a fully enclosed dust conveying system located downstream of said dust discharge valve for providing mechanized transport of the dust discharged through said discharge valve, said fully enclosed conveying system comprising a pneumatic conveying system;

a control system that that controls the opening of said dust discharge valve as a function of a residual conveying capacity of the dust conveying system, said control system controlling the opening of said dust discharge valve as a function of the pressure in said pneumatic conveying system;

a dust storage hopper located near the blast furnace;

a pneumatic conveying conduit connected between said dust discharge valve said dust storage hopper, for transporting the discharged dust from said dry dust collector to said dust storage hopper; and a fluidizing hopper connected to said dust storage hopper; and injection means for injecting the fluidized dust into the blast furnace.

15. A device for discharging dust from a dry dust collector of a blast furnace comprising:

a dust discharge valve located downstream of a dust discharge opening of said dry dust collector;

a fully enclosed dust conveying system located downstream of said dust discharge valve for providing mechanized transport of the dust discharged through said discharge valve;

a control system that controls the opening of said dust discharge valve as a function of a residual conveying capacity of the dust conveying system;

a housing including an inlet opening, said inlet opening being bounded by a concave annular surface that lies on a first fictive cylinder having a horizontal central axis;

a closing body mounted in said housing so that it can be pivoted around said horizontal central axis between a closed position and an open position, wherein said closing body has a convex cylindrical closing surface that lies on a second fictive cylinder, which has a diameter that is slightly smaller than the diameter of said first fictive cylinder;

said closing body having a cutting edge that sweeps across said inlet opening when said closing body is pivoted between said closed position and said open position; and wherein said cutting edge has a concave shape.

16. The device as claimed in claim 15, wherein said concave cutting edge is substantially symmetric with regard to a center plane of said closing body.

17. A device for discharging dust from a dry dust collector of a blast furnace comprising:

a dust discharge valve located downstream of a dust discharge opening of said dry dust collector;

a fully enclosed dust conveying system located downstream of said dust discharge valve for providing mechanized transport of the dust discharged through said discharge valve;

a control system that controls the opening of said dust discharge valve as a function of a residual conveying capacity of the dust conveying system;

a housing including an inlet opening, said inlet opening being bounded by a concave annular surface that lies on a first fictive cylinder having a horizontal central axis;

a closing body mounted in said housing so that it can be pivoted around said horizontal central axis between a closed position and an open position, wherein said closing body has a convex cylindrical closing surface that lies on a second fictive cylinder, which has a diameter that is slightly smaller than the diameter of said first fictive cylinder; and wherein said housing includes an inflatable seal ring, which is mounted around said concave annular surface so that it is pressed against said closing surface in said closed position when it is inflated, but spaced therefrom when it is deflated.

18. A device for discharging dust from a dry dust collector of a blast furnace comprising:

a dust discharge valve located downstream of a dust discharge opening of said dry dust collector;

a fully enclosed dust conveying system located downstream of said dust discharge valve for providing mechanized transport of the dust discharged through said discharge valve;

a control system that controls the opening of said dust discharge valve as a function of a residual conveying capacity of the dust conveying system;

a housing including an inlet opening, said inlet opening being bounded by a concave annular surface that lies on a first fictive cylinder having a horizontal central axis;

a closing body mounted in said housing so that it can be pivoted around said horizontal central axis between a closed position and an open position, wherein said closing body has a convex cylindrical closing surface that lies on a second fictive cylinder, which has a diameter that is slightly smaller than the diameter of said first fictive cylinder; and wherein said housing includes an outlet opening in a ring made of metal carbide, wherein said ring is mounted in a ground plate below said closing body, so as to define a retaining shoulder for retaining a dust cushion on said ground plate around said outlet opening.

* * * * *

UNITED STATES PATENT AND TRADEMARK OFFICE

CERTIFICATE OF CORRECTION

PATENT NO. : 6,802,268 B2
DATED : October 12, 2004
INVENTOR(S) : Yvan Kroemmer et al.

It is certified that error appears in the above-identified patent and that said Letters Patent is hereby corrected as shown below:

Column 7,
Lines 22, 28, 33 and 39, after "claimed", please delete "claim in" insert -- in claim --.

Signed and Sealed this

Fifteenth Day of February, 2005

JON W. DUDAS
*Director of the United States Patent and Trademark Office*